US006357694B1

(12) United States Patent
Adda

(10) Patent No.: US 6,357,694 B1
(45) Date of Patent: Mar. 19, 2002

(54) LASER-SCAN PROCESS AND DEVICE FOR GUIDING A MISSILE TO A TARGET

(75) Inventor: Maurice Adda, Antony (FR)

(73) Assignee: Aerospatiale Matra Missiles, Paris (FR)

( * ) Notice: Subject to any disclaimer, the term of this patent is extended or adjusted under 35 U.S.C. 154(b) by 0 days.

(21) Appl. No.: 09/626,486

(22) Filed: Jul. 26, 2000

(30) Foreign Application Priority Data

Jul. 30, 1999 (FR) ..... 99 09916

(51) Int. Cl.[7] ..... F41G 7/26; F41G 7/24
(52) U.S. Cl. ..... 244/3.13; 244/3.11
(58) Field of Search ..... 244/3.15–3.22, 244/3.13, 3.1–3.12; 342/52, 53, 54, 61–65, 55, 66, 89, 94, 95, 96, 97

(56) References Cited

U.S. PATENT DOCUMENTS 3,695,555 A * 10/1972 Chadwick ..... 244/3.14
3,954,228 A * 5/1976 Davis, Jr. ..... 244/3.16
4,324,491 A * 4/1982 Hueber ..... 244/3.16 X
4,383,663 A * 5/1983 Nichols ..... 244/3.16
5,088,659 A * 2/1992 Neff et al. ..... 244/3.16

FOREIGN PATENT DOCUMENTS

| | | | |
|---|---|---|---|
| DE | 3104318 | 8/1982 | |
| FR | 2593291 | 7/1987 | |
| GB | 2146450 | 4/1985 | |
| GB | 2265273 A * | 9/1993 | ..... G01S/17/42 |

OTHER PUBLICATIONS

French Novelty Search Report, Jun. 9, 2000, Institut National De La Propriété Industriele; Paris, France.

* cited by examiner

*Primary Examiner*—Bernarr E. Gregory
(74) *Attorney, Agent, or Firm*—Stevens, Davis, Miller & Mosher, LLP

(57) ABSTRACT

The present invention relates to a laser-scan process for guiding a missile (M) to a target (T), according to which one observes a field (5), within which said missile (M) is liable to move, so as to locate the latter in said field (5), as well as to a device for implementing said process. According to the invention, in said field (5), a zone (8) is determined around the instantaneous position of said missile (M) thus located, and the laser scan is performed solely in said zone (8).

10 Claims, 2 Drawing Sheets

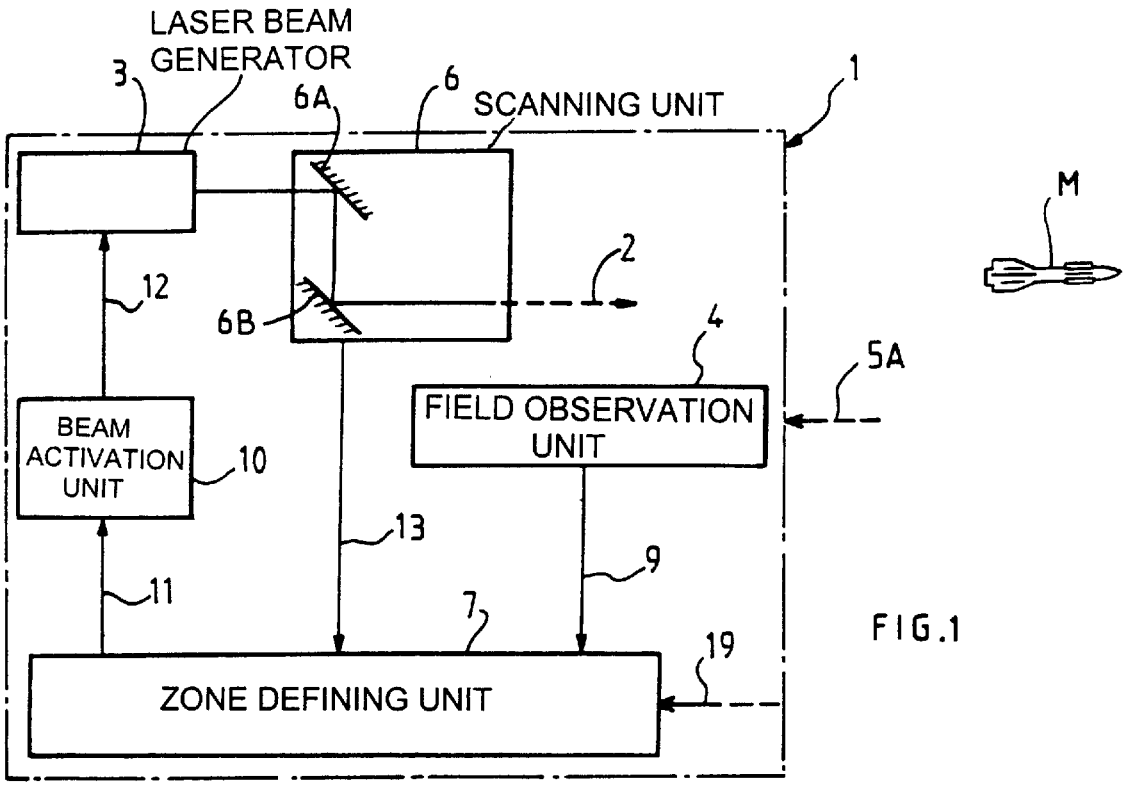
FIG.1
FIG.2
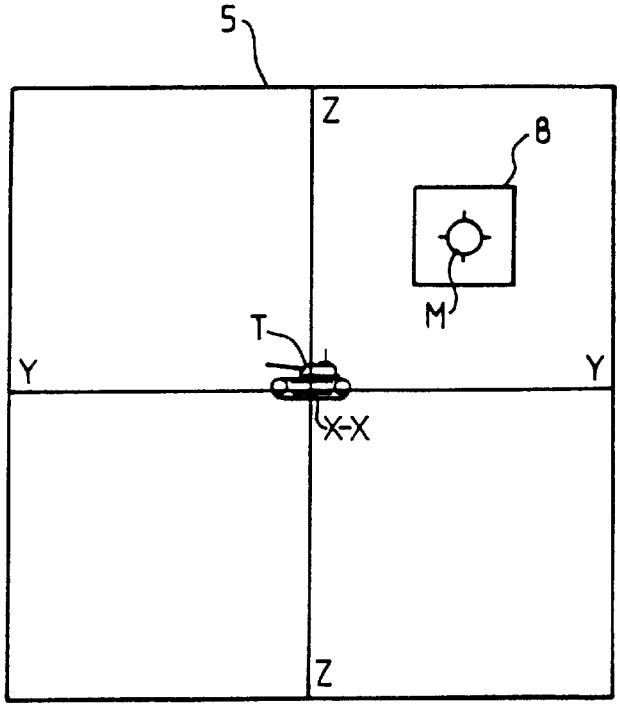

LASER-SCAN PROCESS AND DEVICE FOR GUIDING A MISSILE TO A TARGET

The present invention relates to a laser-scan process and device for guiding a missile to a target.

Although not exclusively, the invention applies more particularly to the guiding of a missile from a firing post, comprising the laser beam projector, an optical receiver being carried on board said missile.

The laser beam projector emits a radial scanning pattern intended to cover the whole of the missile guidance field. It is associated with a direct optical pathway (or any other televisual or thermal optical observation channel).

This arrangement has the drawback, the laser beam scanning the whole of the field, that said beam is then liable to be detected, and the firing post possibly destroyed by the adversary.

The aim of the invention is to reduce the eventuality of detection of the laser beam.

To this end, the laser-scan process for guiding a missile to a target, according to which one observes a field, within which said missile is liable to move, so as to locate the latter in said field, is noteworthy, according to the invention, in that, in said field, a zone is determined around the instantaneous position of said missile thus located, and in that the laser scan is performed solely in said zone.

Thus, the probability of detection of the laser beam is reduced as a function of the reduction in the "surface area" scanned by said beam.

Although one could envisage now scanning only said zone (laser on) while excluding the remainder of the field, it is advantageous (essentially for practical reasons of adaptation of existing systems) that, the scan proper being performed throughout said field, the turning on of said laser beam coincides with the scanning of said zone.

In this case, the "scan" continues to be performed throughout the field, in essence with the laser beam off, the latter only being on, and hence possibly pinpointable, in the specified zone (appreciably reduced with respect to said field) around the instantaneous position of the missile, and the extent of which will depend on various parameters, which vary as a function of the missile firing conditions.

For the implementation of the above process, the invention also relates to a laser-scan device for guiding a missile to a target, comprising:

- means for emitting a laser beam intended for transmitting flight control commands to said missile,
- means for observing a field within which said missile is liable to move, so as to locate the latter in said field, and
- means for scanning said field with said laser beam, which are linked to said emitting means, noteworthy according to the invention by:

- means for defining a zone around the instantaneous position of said missile in said field, which are linked to said observing means, and
- means for activating said laser beam in said zone, which are linked to said means defining said zone.

Advantageously, said means of activating the laser beam are means for turning on said beam in phase with the means for scanning said field so as to make the turning on of said beam coincide with the scanning of said zone.

More particularly, the reduction in detectability of the laser beam is thus achieved by turning on the laser in such a way as to cover only that part of the guidance field in which the missile is to be found.

Advantageously, said observing means comprise a video camera, a semitransparent plate then being able to be interposed in the optical path between the viewfinder and the camera.

Preferably, a monitor allows the visualization of said zone in said field.

Either said monitor shares, with said camera, the same semitransparent plate interposed in said optical path, or said camera and said monitor are offset, and are associated, each, with their own semitransparent plate.

Preferably, a switch makes it possible to go from the laser scanning of said zone to the scanning of said field, when commanded by the operator, this being so as to again locate the missile should the latter leave said zone.

The figures of the appended drawing will elucidate the manner in which the invention may be embodied. In these figures, identical references denote similar elements.

BRIEF DESCRIPTION OF THE DRAWINGS

FIG. 1 is a schematic layout of an exemplary embodiment of the laser-scan device for guiding a missile to a target according to the invention.

FIG. 2 shows the observation field within which a zone is defined around the missile.

DETAILED DESCRIPTION OF THE INVENTION

Figure 3:
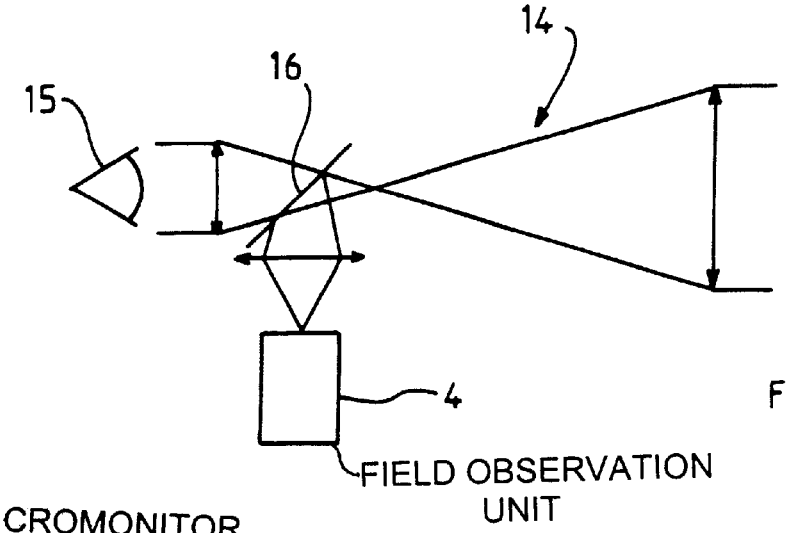
FIGS. 3 to 5 illustrate various imaging means of said device of the invention.

Represented in FIG. 1 is an exemplary embodiment of the laser-scan device 1 for guiding a missile M to a target T (FIG. 2).

The device 1 comprises:

- means for emitting a laser beam 2 intended for transmitting flight control commands to the missile M, comprising a laser beam generator 3,
- means 4 (in particular a video camera, with thermal effect, or the like) for observing a field 5 (FIG. 2), also symbolized by the arrow 5A in FIG. 1 (image received by the camera) within which the missile M is liable to move, so as to locate the latter in the field 5, and
- means 6 for scanning, comprising a fixed mirror 6A and a moveable mirror 6B, the field 5 with the laser beam 2, which are linked to the generator 3.

More particularly, according to the invention, the device 1 furthermore comprises:

- means 7 for defining a zone 8 (FIG. 2) around the instantaneous position of the missile M in the field 5, which are linked to the observing means 4 by a link 9, and
- means 10 for activating the laser beam 2 in the zone 8, which are linked to the means 7 defining the zone 8 by a link 11.

Moreover, the activating means 10 are linked to the laser beam generator 3 by a link 12, and the scanning means 6 to the means of determination 7 by a link 13.

In this example, the means 10 for activating the laser beam 2 are means for turning on said beam (via the link 12) in phase with the means 6 for scanning the field 5 so as to make the turning on of the beam coincide (via the link 13) with the scanning of the zone 8.

The entire radial scan (along the Y—Y; Z—Z axes, assuming the X—X axis to be the one "linking" the firing post to the target) is thus reduced to solely that part (zone 8) of the guidance field 5 in which the missile M is to be found.

To this end, the laser is turned on and turned off in phase with the scanning of the beam in such a way as to make the turning on of the laser coincide when the beam scans the "position" (within the broad meaning of "zone", as used above) of the missile. The firing post detects the position of the missile within the guidance field via a video pick-up, coupled to an image processing box (denoted globally by the numerical reference 7 in FIG. 1).

In the case of a firing post comprising just one direct optical pathway (viewfinder 14 in FIGS. 3 to 5, the numerical reference 15 denoting the observer's eye), the addition of an image pick-up camera 4 is necessary, whilst moreover interposing a semitransparent plate 16 in the optical path (FIG. 3).

Figure 4:
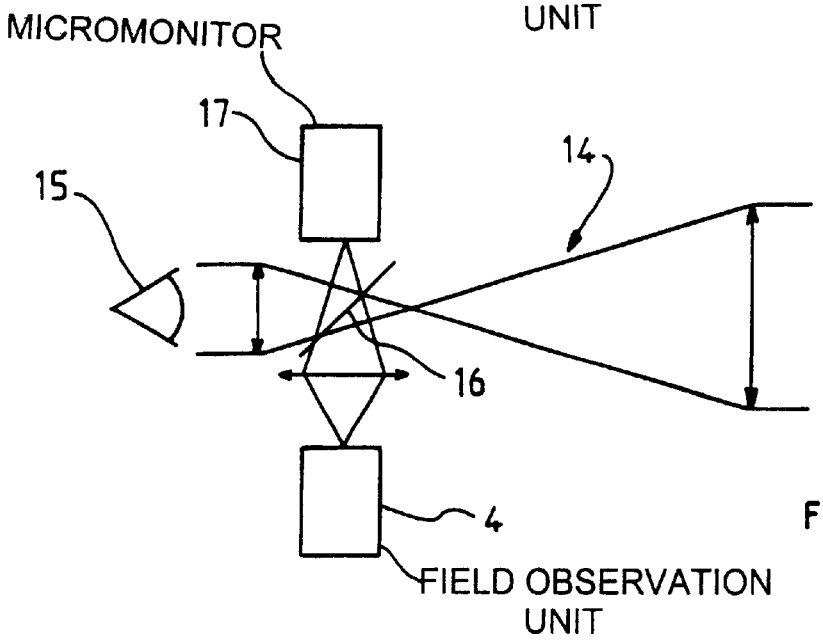
Figure 5:
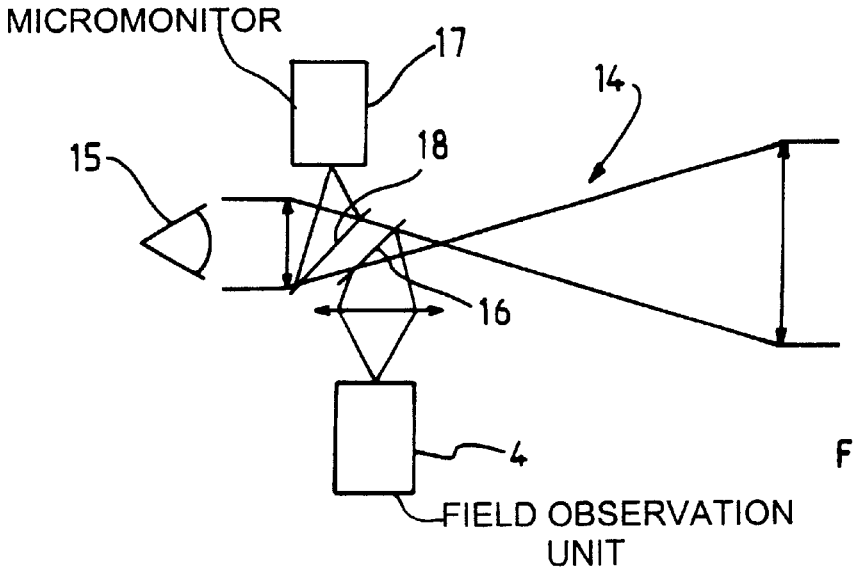

As may be seen in FIG. 4, this optical structure can be supplemented with a micromonitor 17 so as to allow the visualization of the illumination window (or zone 8).

FIG. 4 is a basic layout in which the semitransparent plate 16 allows:

dual observation of the scene by the eye 15 of the observer and by the camera 4, dual observation, by the eye 15, of the scene and of the image of the micromonitor 17.

However, the parasitic observation of the micromonitor 17 by the camera 4 is not excluded in such a layout. It may advantageously be replaced by a layout (FIG. 5), in which the two aforesaid functions are separated, with an additional semitransparent plate 18 (associated solely with the micromonitor 17), making it possible to avoid any parasitic observation.

The advantage of this optical scheme is that it makes it possible to obtain, in overlay on the scene (field 5), visualization of the missile guidance window (zone 8). It is thus possible to envisage, under the assumption that "missile location" would lose the missile (the latter then lying outside the window), dispatching to the locating means 7 (when ordered by the operator) a command (symbolized by the input 19 in FIG. 1) for restoring the complete scanning of the field 5 by the laser beam making it possible to "lock on" to the missile again.

What is claimed is:

1. A laser-scan process for guiding a missile to a target, comprising the following steps:

(a) observing a field, within which said missile moves, so as to locate an instantaneous position of said missile in said field;

(b) determining a zone around the instantaneous position of said missile located in step (a); and (c) performing solely in said zone a scan of a laser beam which transmits flight control commands to the missile for guiding the missile to the target, (c) performing in said zone a laser beam scan.

2. The process as claimed in claim 1, in which the scan of step (b) is performed throughout said field, wherein the turning on of said laser beam coincides with the scanning of said zone.

3. A laser-scan device for guiding a missile to a target, for implementing the process as claimed in claim 1, comprising:

means for emitting a laser beam intended for transmitting flight control commands to said missile, means for observing a field within which said missile moves, so as to locate the missile in said field, and means for scanning said field with said laser beam, which are linked to said emitting means, means for defining a zone around the instantaneous position of said missile in said field, which are linked to said observing means, and means for activating said laser beam in said zone, which are linked to said means defining said zone.

4. The device as claimed in claim 3, wherein said means for activating the laser beam are means for turning on said laser beam in phase with the means for scanning said field so as to make the turning on of said laser beam coincide with the scanning of said zone.

5. The device as claimed in claim 3, wherein said observing means comprise a video camera.

6. The device as claimed in claim 5, further comprising a viewfinder and a semitransparent plate interposed in an optical path between the viewfinder and the video camera.

7. The device as claimed in claim 3, further comprising a monitor for allowing the visualization of said zone in said field.

8. The device as claimed in claim 7, wherein said monitor shares, with said video camera, said semitransparent plate interposed in said optical path.

9. The device as claimed in claim 7, wherein said camera and said monitor are offset, and are associated, each, with their own semitransparent plate.

10. The device as claimed in claim 3, further comprising a switch for making it possible to go from the laser scanning of said zone to the scanning of said field, when commanded by an operator of the device.

* * * * *